United States Patent [19]

Reynolds

[11] Patent Number: 4,963,227

[45] Date of Patent: Oct. 16, 1990

[54] SYSTEM AND APPARATUS FOR RECOVERY OF TURPENTINE FROM THERMOMECHANICAL PULPING PROCESS

[76] Inventor: Ellis W. Reynolds, 2506 Acadie Dr., Jacksonville, Fla. 32217

[21] Appl. No.: 485,047

[22] Filed: Feb. 26, 1990

[51] Int. Cl.[5] ..... D21C 11/06

[52] U.S. Cl. ..... 162/14; 162/23; 162/46; 162/47; 162/55; 162/56; 162/239; 162/251; 162/261

[58] Field of Search ..... 162/14, 15, 16, 47, 162/46, 28, 23, 239, 55, 261, 56, 251

[56] References Cited

U.S. PATENT DOCUMENTS 4,925,527 5/1990 Ryham ..... 162/15

*Primary Examiner*—Peter Chin

*Attorney, Agent, or Firm*—Robert A. Sturges

[57] ABSTRACT

There has been provided a system and apparatus for recovering turpentine from a thermomechanical pulping process for making paper, which thermomechanical pulping process utilizes a plug screw conveyor for squeezing and feeding pulp chips. The thermomechanical pulping process is conventional. The liquid effluent from said plug screw conveyor contains an appreciable amount of turpentine. The liquid effluent is collected under superatmospheric pressure and flashed into vapor/liquid separator by releasing the pressure on the liquid. This vapor is condensed in a suitable condenser and the condensate collected in a decanter where the turpentine collects as a separate phase and the water also as a separate phase. Condensate from various vents in the conventional thermomechanical pulping process may be collected for more nearly compelete removal of turpentine and other oleoresinous components.

8 Claims, 2 Drawing Sheets

SYSTEM AND APPARATUS FOR RECOVERY OF TURPENTINE FROM THERMOMECHANICAL PULPING PROCESS

This invention relates, as indicated, to a system and apparatus for recovering oleoresinous material, mostly turpentine, from a thermomechanical pulping process. In these processes, wood chips, particularly pine wood chips, are introduced into a steaming tube and treated with live steam which softens the resin holding the cellulosic fibers together and ultimately allows the fibers to be isolated from each other. A liquid is recovered from the bottom of the plug type compressing screw conveyor leading from the steaming tube which liquid is mainly water, with about I part of oil (or resin) per 100 parts of effluent from the steaming tube. This oil has been found to be about 98% turpentine, a valuable raw material in chemical synthesis. Heretofore, this effluent from the plug type screw conveyor has been sewered.

The present invention collects this effluent and treats it in a manner to reclaim the turpentine. Thus, this invention has important economic as well as environmental significance.

BACKGROUND OF THE INVENTION AND PRIOR ART

Thermomechanical pulping of wood chips is a relatively recent development dating back to the mid seventies. Basically, it involves washing and debarking pine logs, converting the logs to pine chips of the desired size, and feeding the chips to a steaming tube, which chips have usually been screened to eliminate chips larger than a predetermined size and water washed to eliminate foreign material, such as sand. The chips are exposed to steam at a pressure in excess of atmospheric for several minutes for the purpose of heating and softening the chips.

A screw feeder carries the softened and hot chips to a defibrator. In one embodiment, the defibrator includes a pair of relatively moving grinding discs driven by an electric drive motor rated at from about 1000 to about 10,000 horsepower. The grinding discs gind and defiberize the chips to a predetermined fineness. This operation generates a tremendous amount of heat resulting in steam at a superatmospheric pressure level. Some of this steam can be recycled back to the steaming tube for initial heating of the chips. Normally, the balance of the steam was vented to the atmosphere. Under a preferred form of the present invention, the effluent from the plug screw conveyor can be flashed into a vapor/liquid separator to isolate the turpentine-rich vapor, condensing the turpentine/water and collecting the condensate in a decanter, and the turpentine drawn off the top and sent to storage for sale or further refining.

According to the thermomechanical pulping process, the defiberized chips are conveyed by a suitable conduit to a cyclone separator of conical shape wherein the chips and steam enter along a line tangent to the tapered walls causing the charge to rotate at a high velocity. This action causes the heavier components to fall into the cone while the steam escapes. Normally this steam is vented to the atmosphere. It can, however, be condensed in the course of heat recovery, and combined with the oleoresinous containing fraction of the effluent of the plug screw conveyor, and treated in accordance herewith. The discharge from the primary cyclone is then desirably introduced into a secondary refiner which operates in essentially the same way as the primary refiner. After the secondary refining operation, the resulting pulp passes to a latency chest which temporarily stores the pulp pending further processing, e.g. washing, bleaching, sizing, and casting on a paper making screen (Fourdrinier).

Most thermomechanical pulping processes have heat recovery systems associated therewith. I am not aware that paper manufacturers have heretofore sought &o recover the turpentine which was sewered along with waster water. Environmental and economic considerations now make it desirable and feasible to recover the turpentine and clarify the water discharge. Several hundred thousand pounds of turpentine can be recovered annually from a single thermomechanical pulping apparatus in continuous operation.

Reference may be had to U.S. Pat. No. 4,457,804 dated July 3, 1984 and issued to Reinhall for disclosure of a grinding apparatus useful in the thermomechanical pulping process, and to U.S. Pat. No. 4,437,816 dated Mar. 20, 1984 for another thermomechanical pulping process along with a heat recovery system. The present process and apparatus may be integrated with a thermomechanical pulping process including each of the foregoing patented processes. For example, the liquid exiting a device, such as shown in U.S. Pat. No. 4,437,316, through the funnel 85 in FIG. 1 of said patent, contains about i part turpentine to approx. 100 parts of water, pitch, and fines. In a commercial process, the amount of liquid exiting such a device amounts to about 275 tons per day, or 2.75 tons per day of turpentine, which converts to about 770 gallons of turpentine per day. Turpentine at today's market sells for about $2.00/gallon or about $1500 of turpentine values per day. The turpentine return will, of course depend upon the size and number of the plug screw conveyors. Heretofore, these values were lost.

Turpentine is basically a normally liquid hydrocarbon mixture of mainly alpha and beta pinene with minor amounts of other cyclic terpene hydrocarbons, and unless removed is a contaminant of the water discharged.

BRIEF STATEMENT OF THE INVENTION

Briefly stated, the present invention is a system and apparatus useful in a thermomechanical pulping process for making paper said thermomechanical pulping process utilizing a plug screw conveyor for feeding steam heated pine chips from a steaming tube to a defibrator wherein the effluent from the plug screw conveyor comprising water and an oleoresinous fraction, which is mainly turpentine, is collected, and optionally from condensed vent gases elsewhere in the process, e.g., from the vent stacks associated with the primary and secondary refiners' and from the heat recovery system, and is separated from water and cellulosic fiber, and collected as unrefined turpentine, or further processed to remove a relatively small amount of higher boiling VOC's (Volatile Organic Compounds) and other impurities for sale or use in the plant, e.g. as fuel.

BRIEF DESCRIPTION OF THE DRAWINGS

The invention may be better understood by having reference to the annexed drawings which are diagrammatic and schematic flow sheets showing processes for the recovery of turpentine from a conventional thermomechanical pulping plant and wherein.

DETAILED DESCRIPTION OF THE INVENTION

As indicated above, the invention utilizes the normally sewered effluent from a plug screw conveyor leading from a steaming tube for pine chips. This effluent contains about 1 part by weight of turpentine to 100 parts of effluent. In most cases of thermomechanical pulping, the effluent exits the plug screw conveyor at a superatmospheric pressure, e.g., about 30 psi, and a temperature of about 250 F. This pressurized liquid is conducted to a vapor/liquid separator and flashed to atmospheric pressure causing a vapor phase of turpentine and steam, and an aqueous phase of water, pitch, and other higher boiling oleoresinous materials. The turpentine is condensed in a condenser and collected in a liquid/liquid separator or decanter. The turpentine may then go to storage or further refining.

Figure 1:
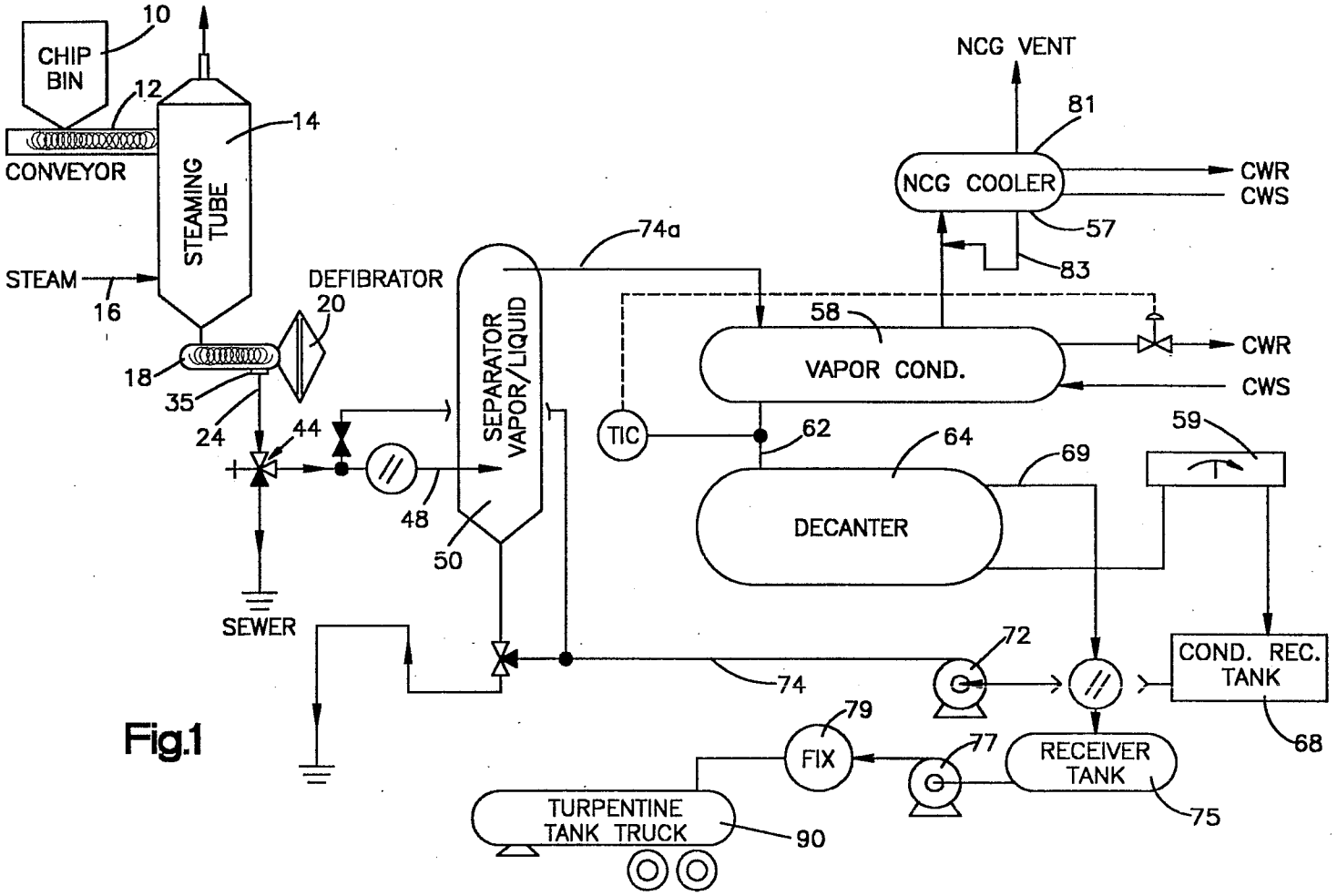
FIG. 1 is a diagrammatic and schematic flow sheet of a simplified and preferred operating process for the recovery of turpentine from a conventional thermomechanical pulping process.
Figure 2:
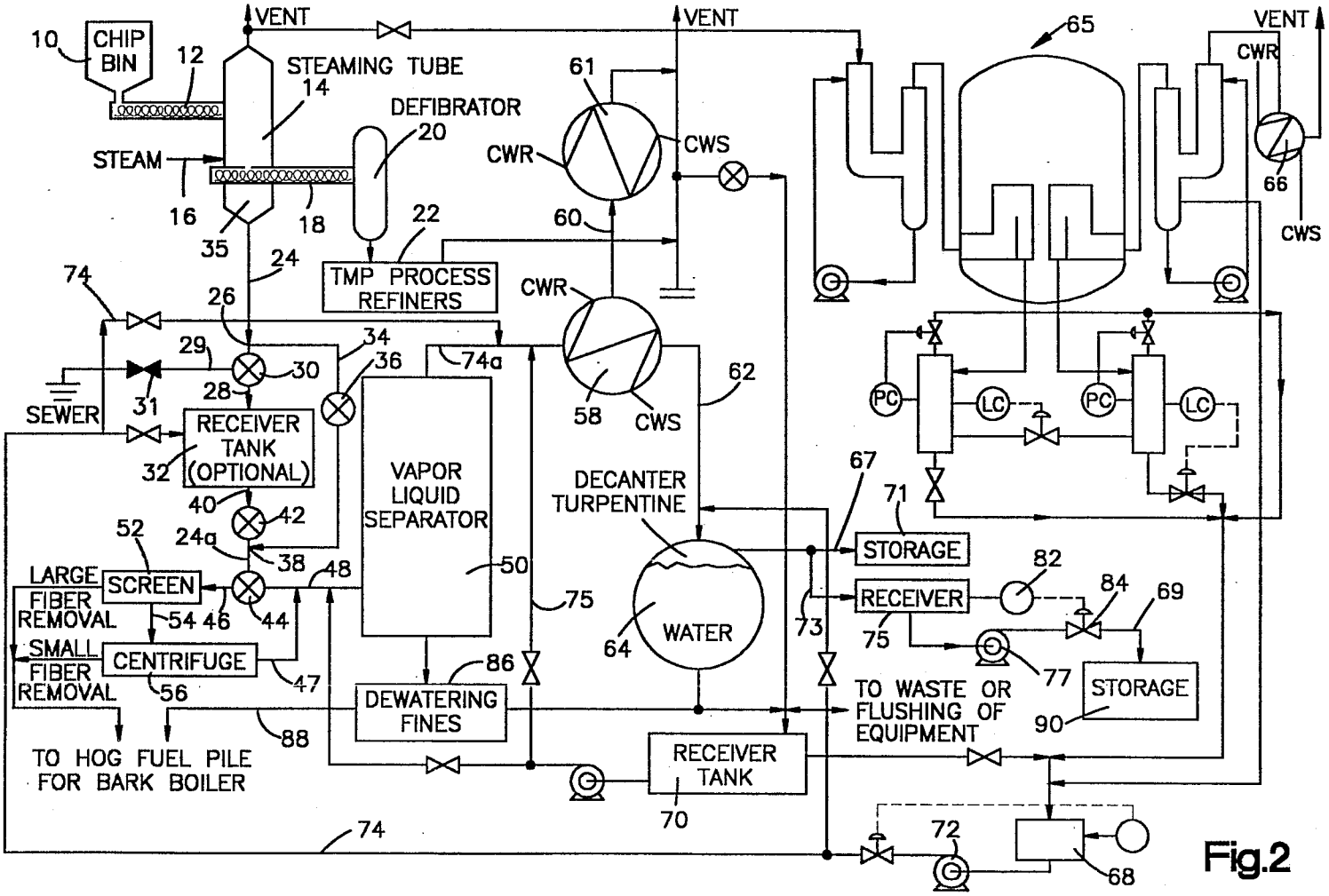
FIG. 2 is a diagrammatic and schematic flow sheet of a more detailed process for the recovery of turpentine from a conventional thermomechanical pulping process and utilizing filtering of the effluent from the plug screw conveyor and recovery of anY turpentine in various vapor streams in the process.

FIG. 1 shows a flow sheet in diagrammatic and schematic form of a simplified process for recovery of turpentine from a thermomechanical pulping process omitting the less productive sources of turpentine in the process. Recovery from such less productive sources may, however, be required at a later date for environmental reasons. In the process of FIG. 1, there is shown diagrammatically a chip bin 10 for storage of pine chips from a chipper, not shown. The chips are conveyed through a screw conveyor 12 to the upper part of a steaming tube 14. Steam is introduced through a steam line 16 to heat the chips to a temperature just below that necessary to liquefy the lignin holding the fibers together but sufficient to soften it. The chips are conveyed by a plug screw conveyor 18 in a sealed system to the inlet of a defibrator 20 such as described in U.S. Pat. No. 4,437,816, supra, the disclosure of which patent is incorporated herein by reference thereto. The chips are compressed in a compression ratio in the range of from 1:1.5 to about 1:3, more or less. During such compression, the turpentine, a small amount of rosin and other oleoresinous components, together with a substantial amount of water are squeezed out of the chips and fall into a drain pan 35 through ports 34 as shown in FIG. 2 of that patent. The drain pan 35 is, however, formed in a pressure tight configuration with the drain element 84 to prevent premature vaporization of the turpentine. The chip fibers from the defibrater 20 are directed to a conventional thermomechanical pulping process (TMP) 22 which need not be further discussed herein.

The drain pan 85 (having the same identifying number in this application as in the aforesaid U.S. Patent for convenience) collects the liquid squeezed out of the steamed chips. This liquid is carried by a conduit 24 to a three-way valve 44. In conventional operation, this line is open to a sewer. With the recovery process hereof, that portion of the line 24 is closed, and the hot liquid conducted through a line 48 to a vapor/liquid separator 50. This liquid is under relatively high pressure, e.g., 80 psi and at a relatively high temperature, e.g., 250 F. is flashed to atmospheric pressure in the vapor/liquid separator 50. The turpentine along with water exits the vapor liquid separator 50 as a vapor, while the condensate comprising mainly water (about 95% water) and pitch and fines (about 5%) is dewatered by any suitable means, not shown in FIG. 1, e.g., a filter or a centrifuge. The water may be cleaned and sewered. Any recovered fines may be returned by a suitable conduit, not shown in FIG. 1, to a hog fuel pile for use in the plant or compacting into briquettes or artificial logs for sale and use as fire starters.

The vapor emanating from the vapor/liquid separator 50 is conducted by a line **74*a* to a vapor condenser 58. The condensate, consisting essentially of a mixture of turpentine and water flows through a line 62 into a decanter 64 where the lighter immiscible turpentine floats as an upper layer, and the heavier water is the lower layer. The turpentine is decanted and conveyed by the line 69 to a receiver tank 75. A pump 77 forces the turpentine through a flow indicator and totalizer 79 and thence into a turpentine tank truck 90** for transport to a user.

Water from the decanter 64 flows through a weir box 59 to a condensate receiver 68 and a pump 72 either to waste or back to the vapor/liquid separator 50 as a flush water.

Noncondensible gas from the vapor condenser 58 goes through a cooler 81, and any condensate is returned to the vapor condenser 58 through a return line 88

The initials S.G. signify a sight glass in a particular line, e.g., the line 48. The initials T.I.C. signify "temperature indicating controller."

A typical thermomechanical pulper system can produce about 250 tons per day of paper pulp. This production will yield about 9500 pounds per hour of water, 13–15 gallons per hour of turpentine, and 100–300 pounds of fines per hour.

Referring now more particularly to the annexed diagram in FIG. 2, wherein similar components have the same numbers as in FIG. 1, there is here shown diagrammatically a pine chip bin 10 having a screw conveyor 12 for conducting the pine chips to the upper part of a steaming tube 14. Steam is introduced through a steam line 16 to heat the chips to a temperature insufficient to liquefy the lignin holding the fibers together. The chips are conveyed by a plug screw conveyor 18 in a sealed system to the inlet of a defibrator 20 such as described in U.S. Pat. No. 4,487,816, supra. The chips are compressed in a compression ratio of from about 1.1:1 to about 3:1, and during such compression, the turpentine, rosin and other oleoresinous components, together with water are squeezed out and fall into a drain pan 35 through ports 84 as shown in FIG. 2 of said patent. As above described in connection with FIG. 1, the drain pan is formed in a pressure tight configuration with the drain element 84 to prevent premature vaporization of turpentine. The compacted chip fibers are directed to a conventional thermomechanical pulping (TMF) process 22 which need not be further discussed herein.

The drain pan S8 (having the same number herein as in the aforesaid U.S. Patent) collects the liquid squeezed out of the steamed chips. This liquid is carried by a conduit 24 to a T fitting 26 where the line splits. One leg 28 leads to a receiver tank 82 through a valve 30. Another leg 29, including a now normally closed valve 31, leads to a sewer. Another leg 34 is a by-pass line including a valve the which leg 34 passes by the receiver tank 32 and reenters the line 24*a* through a T fitting 88. The line 24*a* is connected to the receiver tank 32 through a line 40 including a valve 42. The line 24*a* includes a three way valve 44 connected to lines 46 and 48. Thus, the effluent or discharge from the plug screw conveyor 18 may be combined with fluid in the receiver tank 82 collected from elsewhere in the process, or it may be sent directly to a vapor/liquid separator 50.

The line 46 conducts the effluent alone or combined with the contents of the receiver tank 82 to a fiber screen 52 to separate large fibers from liquid comprising water and oleoresinous material. The large fibers are sent to a hog fuel pile or reclaiming process. The liquid flows through a line 54 to a centrifuge 56 which violates fine fiber from a water/oleoresinous material comprising water, pitch, turpentine and heavier materials which may then be sent through a line 47 to the line 48 and thence to the vapor/liquid separator 50. The wood fines are conveniently sent to the hog fuel pile. In a preferred embodiment the effluent alone or in combination with liquid collected in the receiver tank 32, is sent to the vapor/liquid separator 50. The liquid being under relatively high pressure and at a relatively high temperature, e.g., 80 psi and 250 F., is flashed to atmospheric pressure in the vapor/liquid separator 50. The turpentine along with water exits the vapor/liquid separator 50 as a vapor while the condensate comprising mainly water (about 95%) and pitch and fines (as much as 5%) is dewatered by any suitable means 86 e.g., a filter or centrifuge. The fines are returned by suitable conduit 88 to the hog fuel pile.

The vapor exits into a condenser 58 to isolate turpentine and water as a liquid condensate. Noncondensible gas (NCG), exits through the line 60 into a condenser G1 and the NCG vented to the atmosphere, while the condensate composed of turpentine and water exits the condenser 58 through a line 62 leading to a decanter 64. The condensate is composed of about 1 part of turpentine to 8 parts of water. The turpentine recovered in this manner is about 98% turpentine, and may be further refined by distillation, if desired.

The condensate from line 62 enters the decanter 64. The turpentine collects as a layer floating on top of the water phase. The underflow from the decanter 64 provides hot water for process equipment flush in the recovery plant. From this point, the turpentine can be sen& through a line 69, preferably by gravity flow, to a storage tank 71 for sale or, optionally, further refining, as by distillation.

Where the storage tank 71 is remote from the decanter 64, the line 69 may be split at a T fitting 67 to provide a conduit 78 leading to a receiver 78. From the receiver 75 the turpentine may be pumped by a pump 77 back to the line 69 for delivery to the remote storage tank 71. Suitable liquid level indicating control mean (LIC) 82 and valve 84 are provided.

The balance of the diagram in the annexed drawing illustrates diagrammatically and schematically a conventional heat recovery system 65 for a thermomechanical pulping process which treats vapor emanating from the steaming tube 14. The various condensate components are collected, condensed and sent to a receiver vessel 70, or the vent gas from the reboiler heat recovery unit 65 is condensed by condenser, e.g., condenser 66, and sent to a condensate tank 68. From the condensate tank 68, the liquid comprising water, pitch, turpentine, and miscellaneous oleoresinous materials, is pumped by pump 72 through conduit& 74 to the receiver tank 82 from which tank the condensate may enter the turpentine recovery system as above described. Alternatively, the condensate may be conducted by by-pass line 78 to the vapor stream in line 74*a* for reconditioning of the combined stream to eliminate emulsion build-up of turpentine in water and to increase the efficiency of separation of the turpentine and water. In this way, turpentine from various vents in the thermomechanical pulping system may be submitted to turpentine recovery with the accompanying environmental and economic advantages.

The liquid effluent from the vapor/liquid separator tank 50 contains about 95% water and 5% fines and pitch. This effluent may be dewatered in a suitable apparatus 86, the water sewered and the fines and pitch conveyed along line 88 to the hog fuel pile as fuel for use in the plant or for other uses.

There has thus been provided a system and apparatus for recovering turpentine from a thermomechanical pulping process using a plug screw conveyor, such as that shown in U.S. Pat. No. 4,457,804, which system and apparatus has environmental as well as economic advantages over the prior process wherein effluent from the plug screw conveyor was merely dumped into a sewer.

What is claimed is:

1. A system for recovering turpentine from a thermomechanical pulping process for making paper and utilizing a plug screw conveyor for feeding steam heated pine chips to a defibrator, which system comprises collecting under superatmospheric pressure and elevated temperature the liquid expressed from said chips, flashing the collected liquid into a vapor/liquid separator by releasing the pressure on said liquid, condensing the vapor containing turpentine and water. collecting the liquid condensate in a decanter, and isolating the turpentinecontaining oil phase from the water phase.

2. A system as defined in claim 1 wherein the liquid expressed from said chips is collected in a receiver tank prior to delivery to said vapor/liquid separator.

3. A system as defined in claim 2 which is further characterized by recovering heat from a vapor stream generated in the defibrator in a reboiler heat recovery system, collecting and condensing vent gases issuing from said reboiler heat recovery system and returning the condensate to said receiver tank.

4. A system in accordance with claim 1 further including the steps of screening the liquid expressed from said chips to remove large fibrous components, and centrifuging the liquid from said screening step to remove fine fibrous components prior to delivery of the screened and centrifuged liquid to the vapor/liquid separator.

5. An apparatus for recovering turpentine from a conventional thermomechanical pulping process utilizing a chip bin for holding a supply of pine chips, a conveyor coacting with said chip bin for delivering said chips to a steaming tube for heating said chips, a plug screw conveyor for delivering said chips under pressure and at an elevated temperature above about 200 F. from said steaming tube to a defibrator and squeezing from said chips a hot water/turpentine liquid, means for collecting said water/turpentine liquid under pressure, a vapor/liquid separator connected to said collecting means for isolating a water/turpentine vapor from said water/turpentine liquid and releasing said pressure, a condenser connected to said vapor/liquid separator for condensing said vapor to a liquid mixture of water and turpentine phase, and a decanter connected to said condenser for separating said phases, whereby turpentine is recovered from said thermomechanical pulping process.

6. An apparatus in accordance with claim 5 further including a receiver tank for collecting hot water/turpentine mixture from said plug screw conveyor and vapor condensate generated in the thermomechanical pulping process.

7. An apparatus in accordance with claim 6 also including a reboiler for heat recovery from process vent gases generated in the steaming tube and the defibrator and at least one condenser connected to said reboiler said condenser including means for conducting condensate therefrom to said receiver tank.

8. An apparatus in accordance with claim 6 further including a fiber screen connected to said receiver tank for removing large fibers from the liquid effluent from said receiver tank and a centrifuge downstream of said screen for receiving and removing fine fibers from said liquid effluent, and means for conducting the defiberized liquid to said vapor/liquid separator.

* * * * *